US007549516B2

(12) United States Patent
Eisenhower, Jr. et al.

(10) Patent No.: US 7,549,516 B2
(45) Date of Patent: Jun. 23, 2009

(54) ELEVATOR DOOR INTERLOCK

(75) Inventors: Gary W Eisenhower, Jr., Freeport, IL (US); David E Falcon, Franklin, WI (US); Michael T. Bunyer, Freeport, IL (US); Jeffrey S Hall, Winnebago, IL (US); Richard A Bear, Freeport, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/057,296

(22) Filed: Feb. 11, 2005

(65) Prior Publication Data

US 2006/0180405 A1 Aug. 17, 2006

(51) Int. Cl.
*B66B 13/02* (2006.01)
*B66B 13/06* (2006.01)
*E05C 3/06* (2006.01)

(52) U.S. Cl. ..... 187/331; 187/335; 292/201

(58) Field of Classification Search ..... 200/61.65; 70/277; 187/331, 335; 292/144, 252, 201
See application file for complete search history.

(56) References Cited

U.S. PATENT DOCUMENTS

| | | | | | |
|---|---|---|---|---|---|
| 1,598,064 | A | | 8/1926 | Dunlop | |
| 1,736,805 | A | * | 11/1929 | Simmons et al. | 187/280 |
| 1,901,517 | A | * | 3/1933 | Jacobson | 187/280 |
| 1,949,788 | A | * | 3/1934 | Dunn | 187/283 |
| 2,200,074 | A | | 5/1940 | Bouton | |
| 2,408,054 | A | * | 9/1946 | Fenn | 187/280 |
| 2,520,137 | A | * | 8/1950 | Erler | 187/331 |
| 2,918,988 | A | * | 12/1959 | Green | 187/280 |
| 3,029,900 | A | * | 4/1962 | Baker | 187/314 |
| 3,168,737 | A | * | 2/1965 | Weinstein | 340/825.72 |
| 3,200,905 | A | * | 8/1965 | Holdridge | 187/280 |
| 3,455,127 | A | * | 7/1969 | Simon | 70/277 |
| 3,479,851 | A | * | 11/1969 | Davidson et al. | 70/451 |
| 3,733,861 | A | * | 5/1973 | Lester | 70/153 |
| 4,436,184 | A | * | 3/1984 | Dorman et al. | 187/331 |
| 5,307,656 | A | * | 5/1994 | Gartner et al. | 70/277 |
| 5,487,289 | A | * | 1/1996 | Otto et al. | 70/279.1 |
| 5,508,480 | A | | 4/1996 | Quinlan | 200/16 A |
| 5,636,880 | A | * | 6/1997 | Miller et al. | 292/144 |
| 5,918,704 | A | * | 7/1999 | Chevilliard et al. | 187/335 |
| 6,062,345 | A | | 5/2000 | Olofsson | 187/309 |
| 6,405,834 | B1 | | 6/2002 | Chida et al. | 187/391 |
| 6,442,986 | B1 | * | 9/2002 | Russell et al. | 70/278.3 |
| 6,474,122 | B2 | * | 11/2002 | Davis | 70/278.3 |
| 6,785,603 | B2 | * | 8/2004 | Inoue | 701/112 |
| 6,848,286 | B2 | * | 2/2005 | Dimig | 70/277 |

FOREIGN PATENT DOCUMENTS

| | | |
|---|---|---|
| EP | 0729165 A2 | 8/1996 |
| GB | 1551376 | 8/1979 |

* cited by examiner

*Primary Examiner*—Peter M Cuomo
*Assistant Examiner*—Eric Pico
(74) *Attorney, Agent, or Firm*—Richard H. Krukar; Kermit D. Lopez; Luis M. Ortiz

(57) ABSTRACT

An elevator door interlock incorporates cast parts thereby drastically reducing the number of parts required for assembly. Other elements are also incorporated to further reduce complexity in manufacturing, servicing, and configuration.

14 Claims, 7 Drawing Sheets

ELEVATOR DOOR INTERLOCK

TECHNICAL FIELD

Embodiments relates to elevator door interlocks. Embodiments also relate to simplifying the manufacture, repair, and configuration of elevator door interlocks.

BACKGROUND OF THE INVENTION

Elevators are complex machines. Interlocks help insure proper elevator operation. One of the interlocks ensures that the elevator door is opened only when the elevator is present or during maintenance operations. At a minimum, an elevator door interlock includes a sensor, that senses whether the door is open or closed, and a locking mechanism, that locks the door in the closed position.

Elevator door interlocks should have a housing that protects the parts from outside interference. Current housings are made from stamped pieces of sheet metal. The components of the interlock must be mounted to the housing. The current solutions are to attach mountings to the housing via welding, soldering, screws, bolts, or similar devices or means. It takes considerable time and skill to assemble a housing in this manner. Furthermore, the assembly is prone to breakage because of the large number of parts that are used.

Elevator door interlock housings are typically sheet metal formed into 5 sides of a box type enclosure and a cover, making up the sixth side, completes the enclosure. The covers currently used are simple squares or rectangles of sheet metal. Components of the interlock can be attached to the cover as they are to the housing, bringing along similar problems. The inconvenience of attaching parts to the sheet metal cover usually leads to the cover being merely a cover and otherwise not a part of the elevator door interlock structure.

The sheet metal solutions used for housings and covers also require that any text that should be on the housing or cover to be added as part of a separate operation. That separate operation is usually painting, printing, or affixing an adhesive backed label. These are poor solutions because, over the life of the unit, they wear off.

Elevator doors typically open to the left or to the right. The elevator door interlocks currently used are designed only for left opening or right opening doors. As such, elevator maintenance organizations must stock both the left and right opening varieties. Furthermore, repairmen must go into the field with the correct unit and have the risk of arriving at the job site with the wrong one.

Elevator door interlocks must have a mechanism for locking the door closed and releasing the door when it is proper to do so. The solution is usually to mount a locking fixture to the door that mates with a locking fixture in the elevator door interlock. The elevator door interlock is then mounted to the doorframe. When the door is shut, the two locking fixtures engage. Another part in the interlock housing controls merely engaging the locking fixtures or locking them together. In modern elevators, the controlling part is usually a solenoid. A solenoid, a mechanism wherein an actuator remains in a default position until electrical current is applied causing the actuator to move to an energized position, is well known in the art of electromechanical devices and particularly in the art of elevator door interlocks. Solenoids require a specified electrical current or voltage for proper operation. For example, a 24-volt DC solenoid requires a steady voltage of approximately 24 volts. Alternating current or too low a voltage would not work. Too high a voltage could destroy the solenoid. Furthermore, keeping a solenoid energized for long periods of time can cause the device to overheat and fail. Once again, repairmen must arrive at the job site with elevator door interlocks that match the electrical power used at that job site.

Elevator door interlocks often keep the solenoid energized when the door is unlocked. This shortens solenoid life.

BRIEF SUMMARY

It is therefore one aspect of the embodiments to provide a cast housing for an elevator interlock housing.

It is another aspect of the embodiments to provide for the use of a cast cover instead of a stamped sheet metal cover to close the housing.

It is a further aspect of the embodiments to form text or pictograms into the cast housing or into the cast cover for conveying information.

It is also another aspect of the embodiments to use an electrical circuit that utilizes either AC or DC electricity as a power source.

It is an additional aspect of the embodiments to use symmetrical parts to reduce manufacturing costs and enable easy reconfiguration of the elevator door interlock.

It is yet a further aspect of the embodiments to utilize a snap over center arrangement of a locking cam to hold and release the door.

The aforementioned aspects and other objectives and advantages can now be achieved as described herein. As indicated above, one aspect of the embodiments is the use of a cast housing for an elevator interlock housing. Casting is a process by which a mold is used to produce a shaped part as a single piece. The shape of the housing can include the mountings and fasteners for the parts that must go into the housing. For example, solenoids are often fastened with a bolt and a nut. A cast housing allows other mounting methods to be used. One fastening method that can be used is to form a thickened threaded portion of the housing to mate with a bolt instead of using a nut to mate with the bolt. A mounting method that can be used is forming a mounting, as part of the housing, into which the solenoid snaps or slips into place. This example illustrates the reduction in parts count that is possible for the solenoid. There are many more components that must be similarly mounted in the housing. The mountings for many of those components can be formed into the cast housing.

Another aspect of the embodiments is to use a cast cover instead of a stamped sheet metal cover to close the housing. The mounting for a component can be formed in two parts. One part of the mounting is formed as part of the housing and the other part is formed as part of the cover. When the cover is attached to the housing, the two parts of the mounting are also joined to form a complete mounting that holds a component securely.

Another aspect of the embodiments is to form text or pictograms into the cast housing or into the cast cover for conveying information. Cast in text or pictograms are unlikely to wear off during the useful life of the housing or cover.

Another aspect of the embodiments is use an electrical circuit that uses either AC or DC electricity as a power source. Elevator door interlocks are usually part of an elevator control circuit. Different circuits are constructed with different electrical power supplies. Some installations use direct current, or DC. Others use alternating current, or AC. Elevator door interlocks that operate with either AC or DC electricity allow the same interlock to be used in more installations. This results in stocking fewer parts and a lower likelihood that repairmen reach the job site with the wrong part.

Another aspect of the embodiments is the use of symmetrical parts to reduce manufacturing costs and enable easy reconfiguration of the elevator door interlock. Doors can open to the left or to the right. The correct elevator door interlock must be used for each installation. Designing the unit with symmetrical components allows the exact same components to be used in either left or right opening units. If a repairman needs to install a left opening unit, but only has a right opening one, it is a simple operation to open up the unit, move the components, and thereby convert the left opening unit into a right opening one. The result is that fewer components are required for the manufacture of left and right opening units because both types use the same components. Another advantage is that a repairman at the job site with the wrong unit can easily convert it instead of returning for the correct unit.

Another aspect of the embodiments is using a snap over center arrangement of a locking cam to hold and release the door. In certain elevator door interlocks, a cam is a part of the locking fixture that resides in the housing. Snap over center is a type of action where a mechanism has two resting positions and, when not at rest, exerts force in an attempt to reach one of the resting positions. The cam rests in either the locked or the unlocked position. Snap over center action can be obtained by pressing a ball bearing against the side of the cam if the cam profile is properly designed.

One advantage of the snap over center action is that, unless there is outside force applied, the cam is always in a rest position. This enables more accurate alignment between the locking fixtures. It also enables use of cam position sensors that detect when the cam is in a rest position. When the locking cam is in the locked position, a solenoid can be used to lock the cam in place, thereby locking the door. A cam position sensor can be used to sense that the cam is in the locked position and turn off electrical power to the solenoid, which will keep the door locked without causing the solenoid to heat up. A similar sensor can cut solenoid power when the cam is in the unlocked position. As such, the solenoid is only energized when it needs to be, increasing the lifespan of the solenoid.

DETAILED DESCRIPTION

Figure 1:
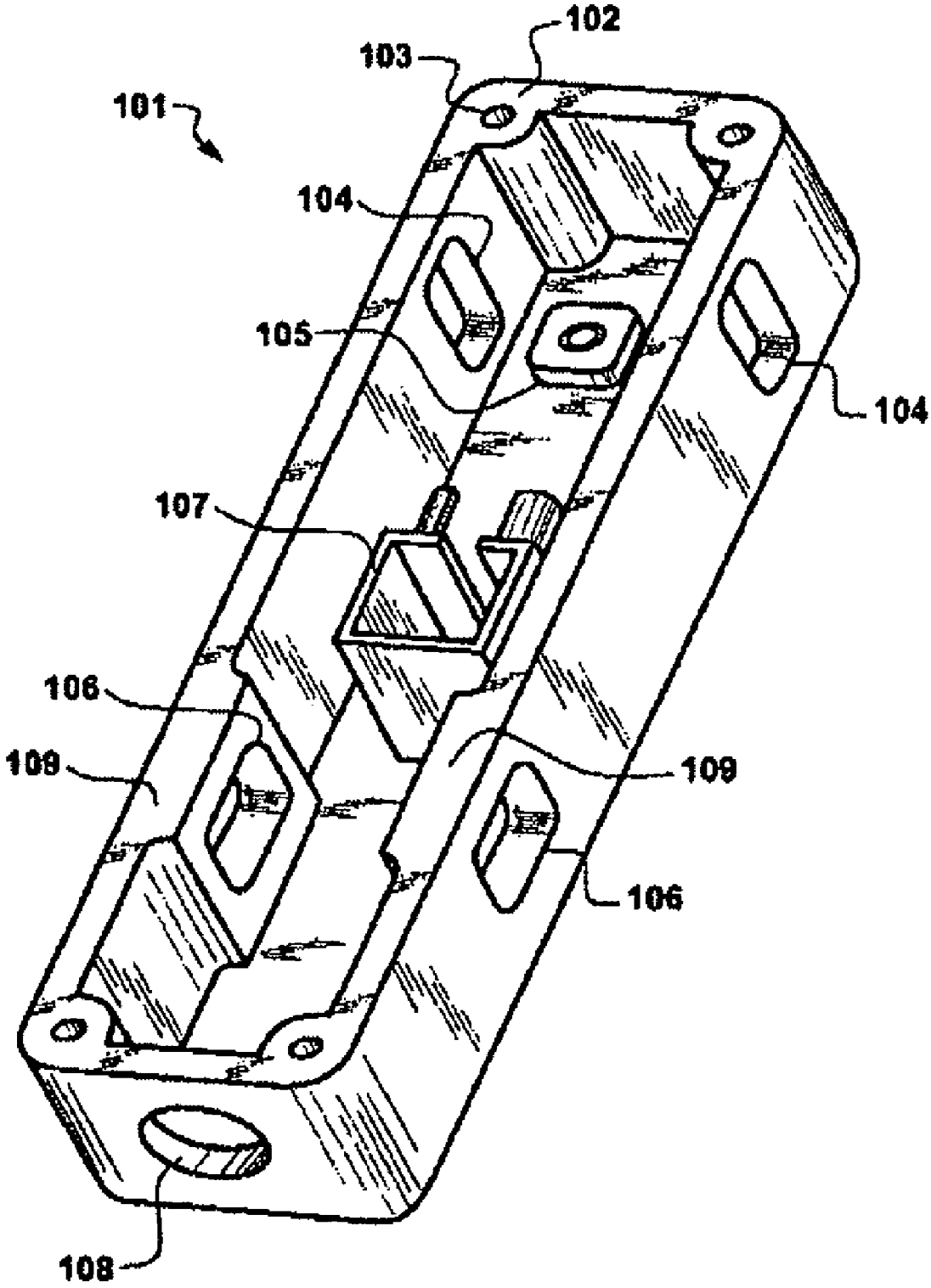
FIG. 1 illustrates a cast housing in accordance with a preferred embodiment.

In accordance with a preferred embodiment, FIG. 1 illustrates a cast housing 101 that can be formed as a single piece that incorporates mounting points and other elements. One of the advantages of the cast housing 101 is that it can possess thickened areas such as thickened areas for bolts 102 or thickened areas for other mountings 109. The thickened area for bolts 102 can be simply a place where a bolt hole 103 is placed and threaded so that a bolt can be screwed into that location.

Bolts are used to fasten things together. Single bolt holes and bolt hole patterns are examples of mount points. In general, a mount point is a place where two or more components of an assembly are joined together. The cast housing 101 can also have a locking fixture window 104 that is an opening where a locking fixture, such as the cam actuator illustrated later, can enter. The cast housing 101 can have a cam axle mount 105, which is a thickened area with a hole meant to hold an axle on which a cam rotates. The cast housing 101 can have a door sensor window 106, which is a place to mount a sensor that detects the presence of the elevator door.

The cast housing 101 can have a portion of a mounting, such as a solenoid mount portion 107. The portion that is part of the cast housing 101 can be designed such that a solenoid drops into it and then another portion of the mount is added to form a complete mount that holds the solenoid completely. The cast housing 101 also has a wire window 108. The elevator door interlock has some electrical parts and they must be electrically connected to elevator control circuitry. The wires from the control circuitry enter the cast housing 101 via the wire window 108. Usually the outside wires from the control circuitry connect to the circuitry inside the cast housing 101 via multi element electrical connectors.

Figure 2:
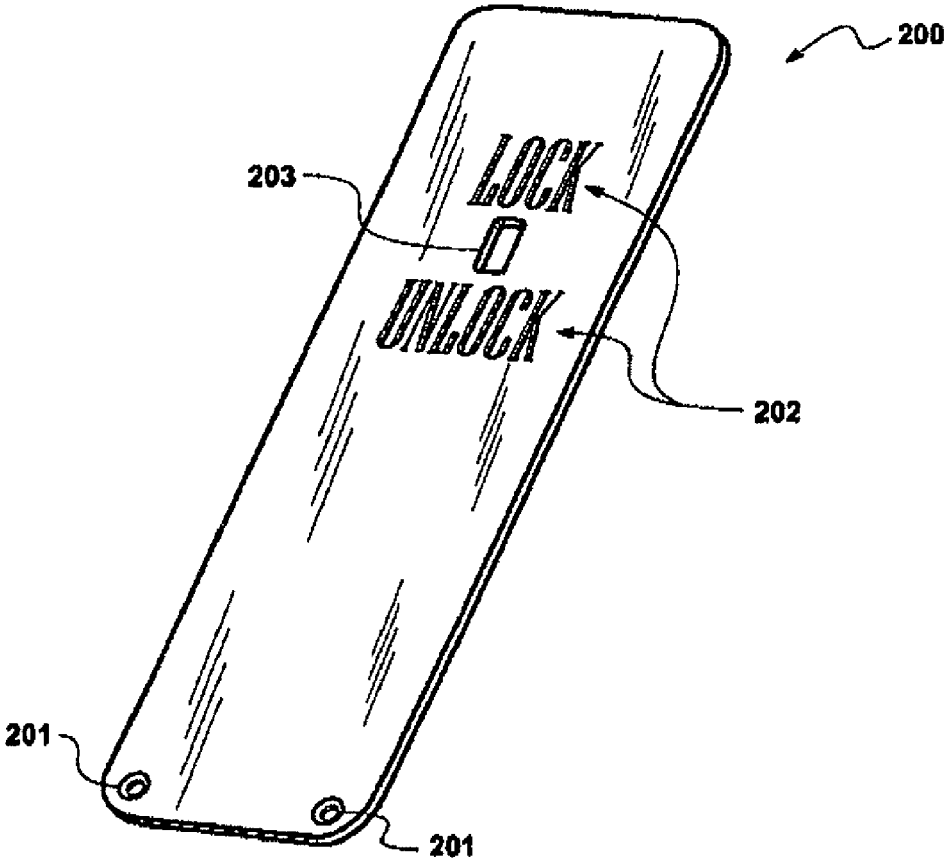
FIG. 2 illustrates a cast cover in accordance with an embodiment

FIG. 2 illustrates the top side of a cast cover 200. The cast cover 200 is also formed as a single piece that incorporates other elements. The cast cover 200 can have countersunk holes 201. The countersunk holes 201 shown are ideal for bolting the cast cover 200 to the cast housing 101. The cast cover 200 can have lettering 202 or other patterns formed into its surface. The cast housing 101 can also have patterns other than lettering formed into its surface. The cast cover 200 can also have windows such as the manual release window 203. A manual release window 203 is designed to enable manual operation of the locking mechanism inside the elevator door interlock.

Figure 3:
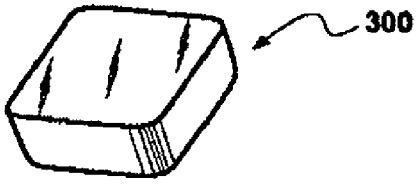
FIG. 3 illustrates a cast inner cover in accordance with a preferred embodiment.
Figure 4:
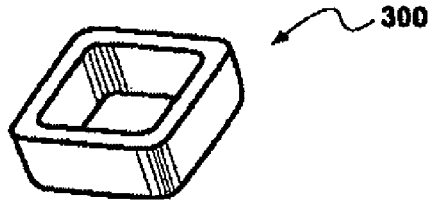
FIG. 4 illustrates a cast inner cover in accordance with a preferred embodiment.

FIG. 3 and FIG. 4 show a cast inner cover 300. The specific cast inner cover 300 shown is meant to mate with the solenoid mount portion 107. When the two parts mate, a complete solenoid mount is formed. A cast housing 101 can have other mount portions for components other than solenoids. As such, there can be other cast inner covers that mate with those portions to form complete mounts.

Figure 5:
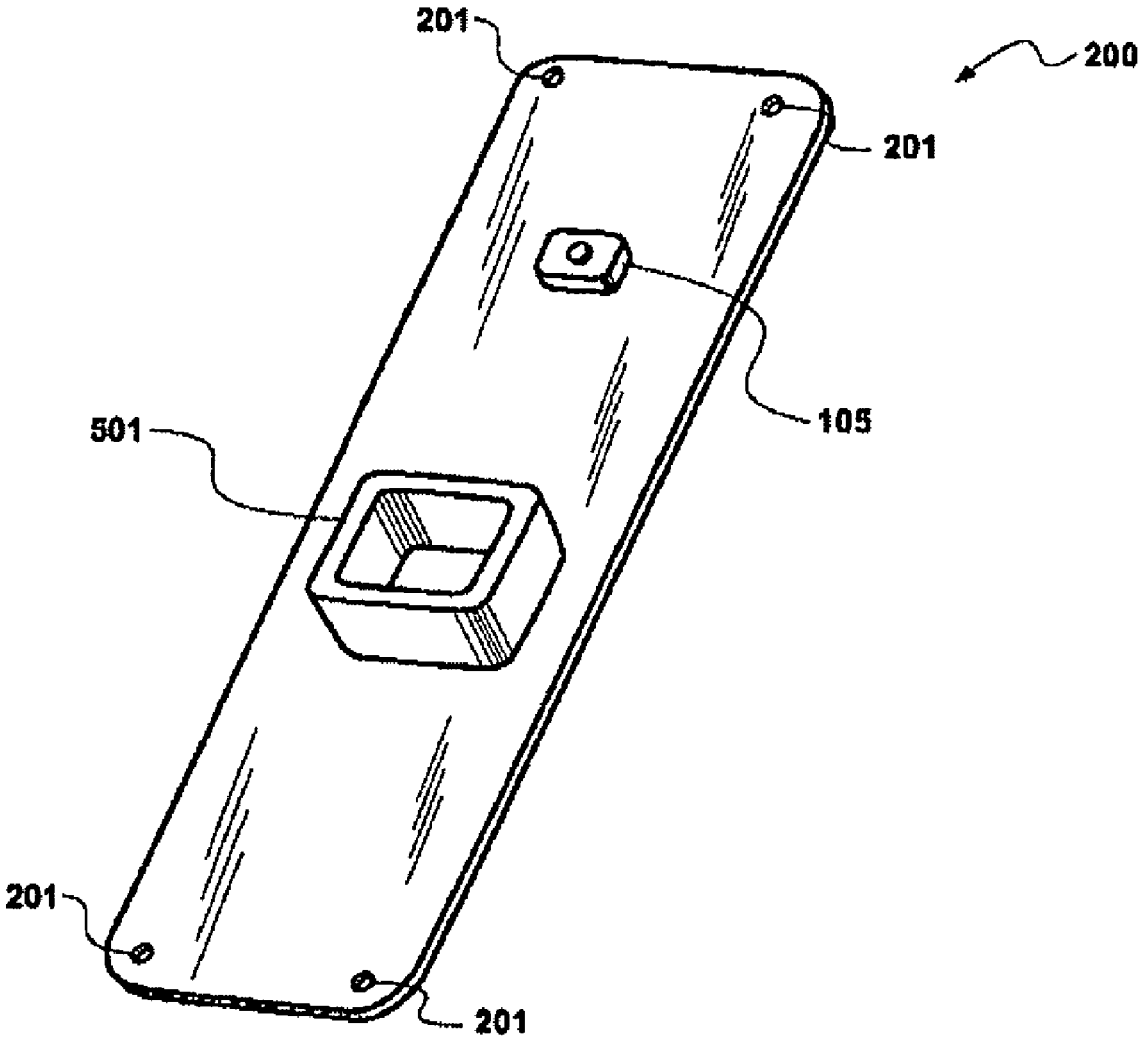
FIG. 5 illustrates a cast cover in accordance with a preferred embodiment.

FIG. 5 illustrates the bottom side of a cast cover 200. The cast cover 200 can have a cam axle mount 105 that, in concert with the cam axle mount 105 in the cast housing 101, completely contains the cam axle. Two cam axle mounts are not necessary for all types of cam mountings. The arrangement shown here conveys the wide range of elements that can be incorporated into a single cast part. The arrangement described herein is not intended to limit the types of cam mountings that can be utilized, because there are many types of cam mountings well known to those skilled in designing elevator door interlocks. The cast cover 200 can also have a solenoid mount portion 501. The solenoid mount portion 501 shown is analogous to that shown in FIG. 3 and FIG. 4, except that it is incorporated into the cast cover.

Figs 1, 3-5 illustrate a cast housing 101, cast inner cover 300, and cast cover 200 having left-right symmetry. The left-right symmetry of the cast housing 101 is apparent in that the locking fixture windows 104 and door sensor windows 106 are mirrored on the left and right sides of the cast housing 101. Other elements, such as the cam axle mount 105 and solenoid mount portion 107 also have left-right symmetry and are positioned within the cast housing 101 in a manner that preserves the left-right symmetry of the cast housing 101. Similarly, the cast cover 200 has left-right symmetry such that it can fit onto a left-right symmetrical cast housing 101.

Elevator doors can open from the left side or from the right side of an elevator door interlock. As such, elevator door interlocks exist as right side or left side models. A cast housing 101 with left-right symmetry can allow for one elevator door interlock model to be easily reconfigured into the other model and for one cast housing design to be manufactured for use with both models.

Figure 6:
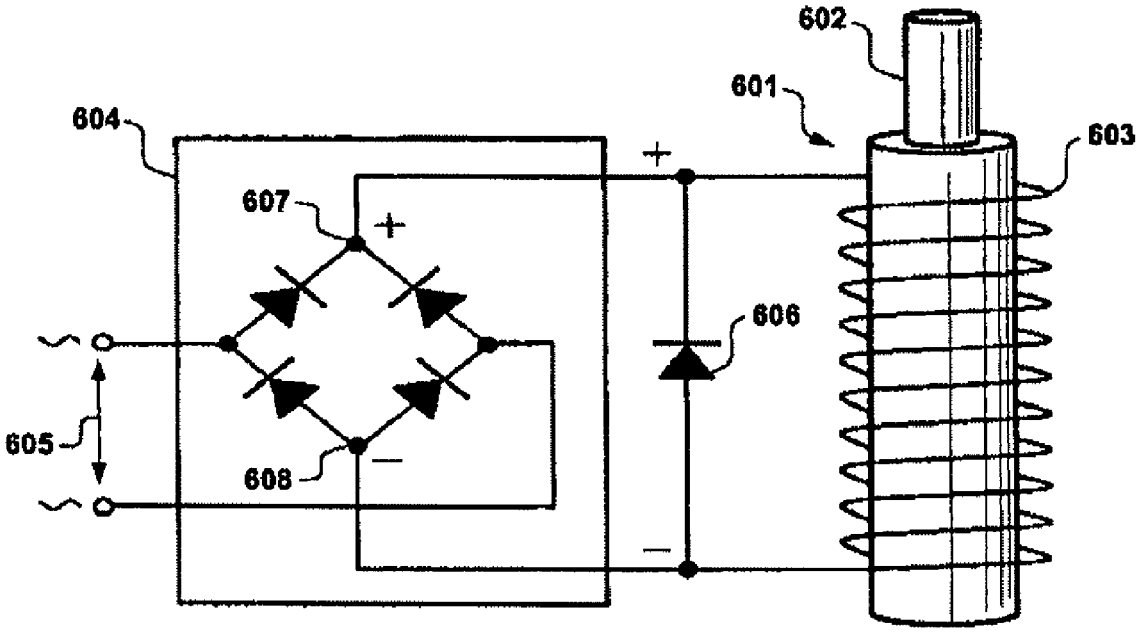
FIG. 6 illustrates a circuit diagram in accordance with a preferred embodiment.

FIG. 6 illustrates a circuit diagram of one way to operate a solenoid 601 with either AC or DC electrical power. A solenoid 601 is an electromechanical device wherein the actuator 602 moves when electrical power is applied to the coil 603. Electric current is commonly direct current (DC), such as a battery produces, or alternating current (AC), such as a generator produces. A rectifier is an electrical device that causes electrical current to flow in only one direction. A full wave bridge rectifier 604 is a type of rectifier.

When an electric current, either AC or DC is applied to the full wave bridge rectifier input 605, rectified current flows out of the rectifier positive output 607 into the coil 603, and then into the rectifier negative output 608. A flyback diode 606 is connected in parallel with the coil 603 to protect against flyback, a condition that occurs when the coil 603 is de-energized Rectifiers, solenoids, flyback diodes, and full wave bridge rectifiers as individual components or subassemblies are known to those skilled in the art of electric circuitry.

Figure 7:
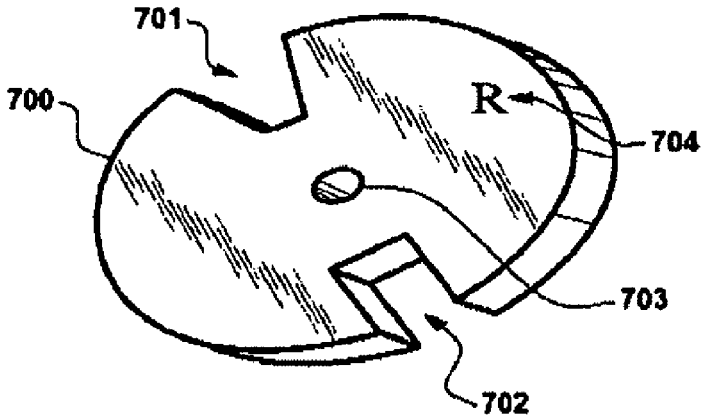
FIG. 7 illustrates a cam in accordance with a preferred embodiment.
Figure 8:
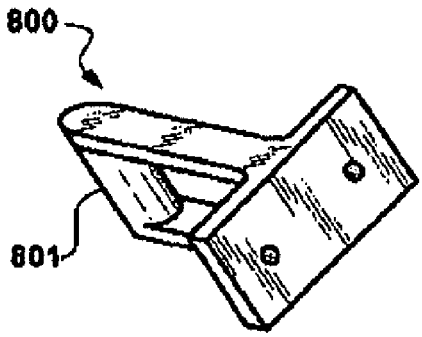
FIG. 8 illustrates a cam actuator in accordance with a preferred embodiment.

FIG. 7 illustrates a cam 700. The cam 700 rotates around an axle that goes through the axle hole 703. At least one cam axle mount 105 holds a cam axle that goes through the axle hole, thus confining the cam within the cast housing 101 wherein it rotates about a single axis. The cam 700 is one part of the locking fixture. FIG. 8 illustrates another part of the locking fixture, the cam actuator 800. The cam actuator 800 is attached to the elevator door. The cast housing 101 is attached to the doorframe. As the elevator closes, the lock bar 801 portion of the cam actuator 800 enters into the cast housing via the locking fixture window 104.

Inside the cast housing 101, the lock bar 801 engages the lock bar notch 701 and causes the cam 700 to rotate. When the elevator door reaches its closed position, the cam 700 reaches the lock position at which time the solenoid actuator 602 can enter into the solenoid notch 702 thereby locking the cam 700, cam actuator 800, and elevator door in place. To unlock the elevator door, the solenoid actuator 602 must be retracted from the solenoid notch 702. This is accomplished by applying electrical power to the solenoid 601 or by physically pushing the solenoid actuator 602.

Figure 9:
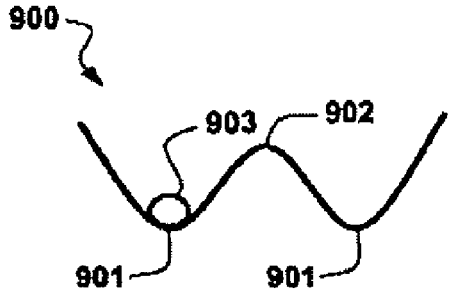
FIG. 9 illustrates snap over center operation accordance with a preferred embodiment.

FIG. 9 illustrates an example of a type of snap over center action. A hill 900 resides between two valleys 903. A ball 903 rests in a valley 901. To move the ball 903 from one valley 901 to the other, it must be pushed up the hill 900. When it passes the cusp 902, the ball 903 rolls to the other valley 901. It takes force to move the ball 903 toward the cusp 902. The force of gravity moves the ball 903 toward a valley 901. This is an example of snap over center action. The ball 903 has two resting positions and a cusp 902 between them. It takes force to move the ball 903 from a resting position and a force always pushes the ball 903 toward a resting position.

Figure 10:
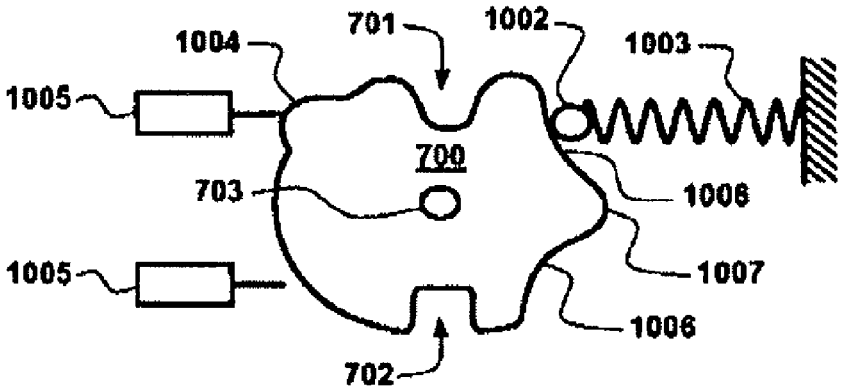
FIG. 10 illustrates a cam in accordance with a feature of the embodiment.

FIG. 10 illustrates a cam 700 with snap over center action. A spring 1003 presses a ball bearing 1002 against the side of the cam 700. This is analogous to the example of FIG. 9. The ball bearing 1002 is like the ball 903. The force of the spring 1003 is like the force of gravity. The cam profile is like the hill 900 in that it has a cusp 1007 and two resting positions 1006. The cam 700 also has a protrusion 1004. When the ball bearing 1002 is in a rest position 1006, the protrusion 1004 engages one protrusion sensor 1005 or the other. The protrusions sensors 1005 detect when the cam 700 is in the lock position, unlock position, or neither position because rest positions 1006 correspond to the lock and unlock positions.

The protrusion sensors 1005 can be used to cut electrical power to the solenoid 601 when the cam 700 is in either the lock or unlock position. When the elevator door is fully closed, the cam 700 is in the lock position. When someone tries to open the elevator door, the cam actuator 800 pulls the cam 700 slightly out of the locked position thereby allowing the solenoid 601 to be energized. This is possible because the solenoid notch 702 is wide enough to allow it. If it is proper to open the elevator door the solenoid 601 can be energized which withdraws the solenoid actuator 602 from the solenoid notch 702, and allows the door to be fully opened. If the door can't be properly opened, the solenoid 601 is not energized and the door remains locked shut. Whoever is attempting to open the door then lets go and the snap over center action rotates the cam 700 to the locked position. In this manner, the solenoid 601 is not continuously energized whenever it is proper to open the door, only when it is proper and someone is attempting to open the door. Similarly, if the door is open and the cam 700 is resting in the unlock position then the solenoid 601 should not be energized. When the solenoid 601 is not energized, the solenoid actuator 602 pushes against the side of the cam 700, but does not enter a notch because none is present. As the door closes, the cam actuator 800 engages the cam 700 and rotates it to the locked position whereupon the solenoid actuator 602 snaps into the solenoid notch 702.

The protrusion sensors 1005 are presented as examples of a way to sense cam 700 position. One skilled in the art of elevator door interlocks should appreciate many different and equivalent ways to sense cam 700 position after reading this disclosure. In accordance with this aspect, any sensor that can sense cam position can be used to sense when the cam 700 is in any particular position such as the lock position or the unlock position.

Figure 11:
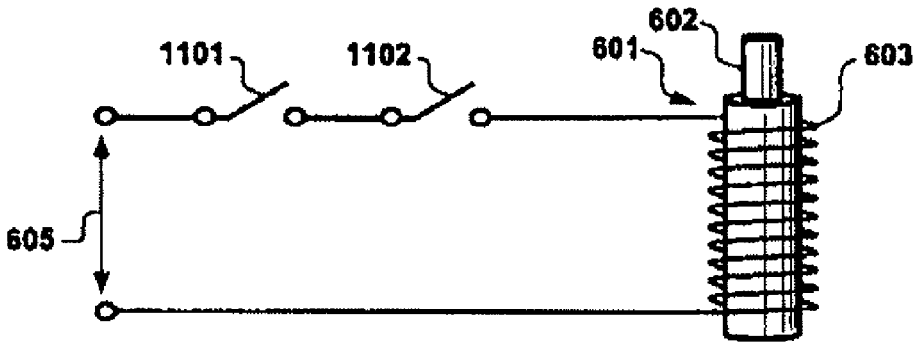
FIG. 11 illustrates a circuit diagram in accordance with a feature of the embodiment.

FIG. 11 is a circuit diagram showing one of the many possible circuits that can cut electrical power to the solenoid 601 when the cam 700 is in either the lock or unlock position. The lock position sensor 1101 is a switch that opens when the cam 700 is in the lock position. In any position other than lock, this switch is closed. The unlock position sensor 1102 is a switch that opens when the cam 700 is in the unlock position. In any position other than unlock, this switch is also closed. When either switch is open, the solenoid 601 receives no electric power.

Figure 12:
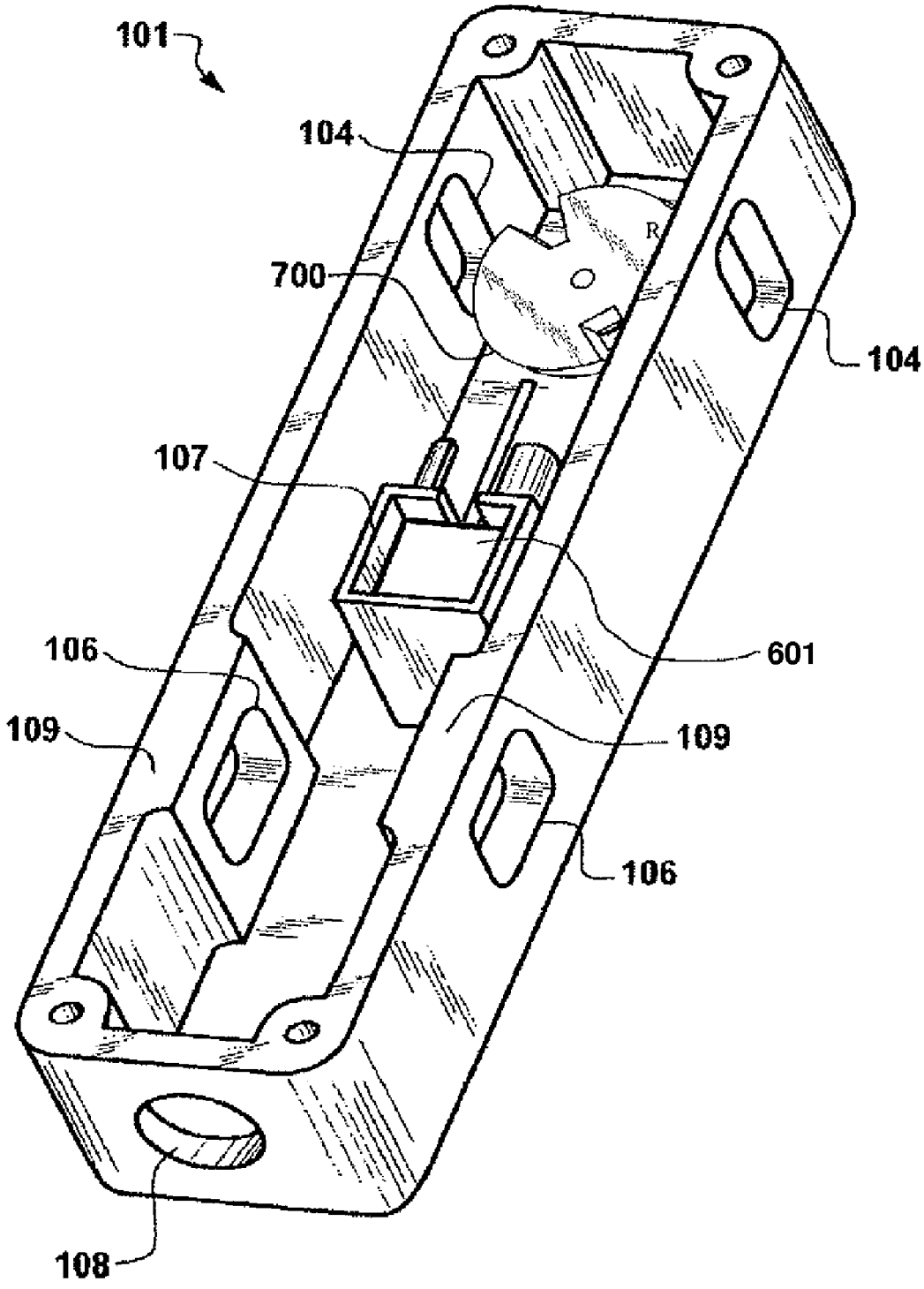
FIG. 12 illustrates left-right symmetry in accordance with aspect of the Embodiments.

FIG. 12 illustrates left-right symmetry in accordance with aspects of the embodiments. The only figures in which symmetry is not apparent is FIG. 7 and FIG. 8. FIG. 12 clarifies the meaning of left-right symmetry by illustrating the cam 700 and the solenoid 707 inside the cast housing 101. The symmetry of the cam 700 can be exploited by flipping it over. The direction indicator 704 is an "R" indicating that the cam 700 is in the right side opening position. Flipping the cam 700 over means placing it such that the "R" is facing down instead of up as it is in FIG. 7. The solenoid 707 is located in a position wherein it need not be moved, flipped, or otherwise adjusted. When not energized, The solenoid 707 can extend to engage the cam 700 and lock it in place. The cam actuator 800 of FIG. 8 does not need configured. It needs to be mounted to the elevator door such that it enters into the cast housing 101 via a locking fixture window 104. The cast housing 101 has locking fixture windows 104 on both the left and right sides.

Another aspect of the embodiment is an electrical door sensor. The door sensor senses when the elevator door is in the shut or nearly shut position.

Figure 13:
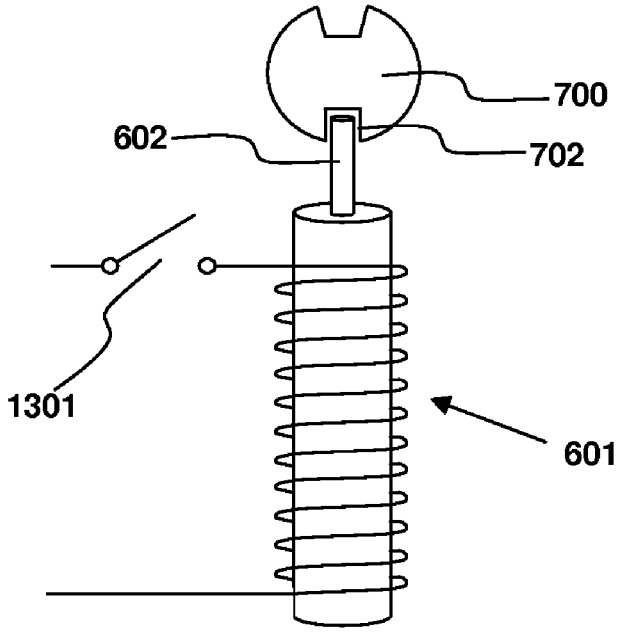
FIG. 13 illustrates a not energized solenoid extending to engage a solenoid notch.

FIG. 13 illustrates a not energized solenoid 601 extending to engage a solenoid notch 702. An open switch 1301 can cause the solenoid 601 to not be energized. As such, the actuator 602 extends to engage the solenoid notch 702 in a cam 700.

Figure 14:
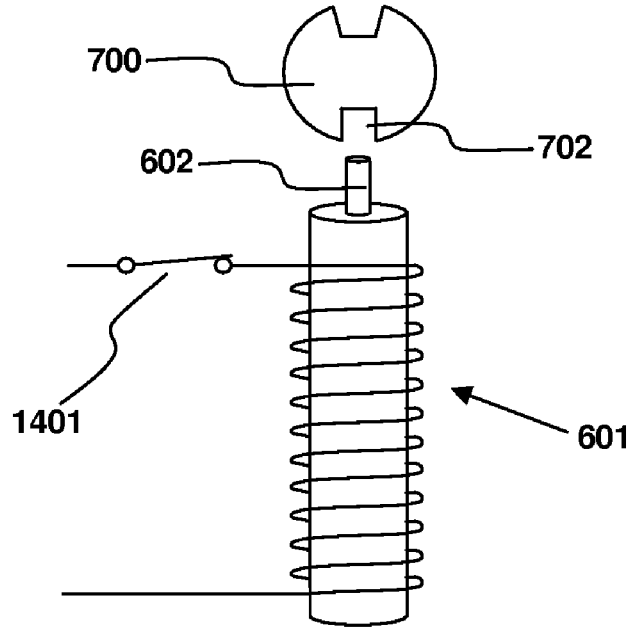
FIG. 14 illustrates and energized solenoid that is retracted to allow a cam to rotate.

FIG. 14 illustrates an energized solenoid 601 that is retracted to allow a cam 700 to rotate. A closed switch 1301 can cause the solenoid 601 to be energized. As such, the actuator 602 retracts and the cam 700 is free to rotate.

It will be appreciated that variations of the above-disclosed and other features, aspects and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system comprising:

a cast housing;

a cam comprising a solenoid notch wherein the cam rotates within the cast housing, wherein a cam axle mount positions the cam, and wherein the cam locks and frees a cam actuator;

a spring and a ball bearing wherein the spring presses the ball bearing against the cam and wherein the cam has a cam profile that is adapted for snap over center operation; and a solenoid that, when not energized, extends to directly engage the solenoid notch to lock the cam and that, when energized, retracts to allow the cam to rotate and free the cam actuator to thereby provide an elevator door interlock.

2. The system of claim 1 wherein the cast housing comprises two locking fixture windows on opposite sides of the cast housing wherein the cast housing is symmetrical such that the locking fixture windows are mirror images of one another and wherein the cam actuator enters the cast housing through one of the two locking fixture windows.

3. The system of claim 2 further comprising a cast cover comprising a cam axle mount.

4. The system of claim 1 further comprising a cast cover comprising a solenoid mount portion.

5. The system of claim 1 further comprising a means for reconfiguration such that rearranging the components within the cast housing configures the elevator door interlock for left side or right side operation.

6. The system of claim 1 wherein the cast housing comprises a means for reconfiguring the elevator door interlock for left side or right side operation without requiring additional parts.

7. The system of claim 1 wherein the cam comprises an axle hole, and wherein an elevator door interlock configured for left side operation is reconfigured for right side operation by removing the cam from the cast housing, rotating the cam by 180 degrees around an axis perpendicular to the axle hole, and placing the cam back into the cast housing.

8. The system of claim 1 further comprising at least one protrusion sensor wherein the cam comprises a protrusion and wherein the at least one protrusion sensor senses the cam protrusion.

9. A system comprising:

a cast housing;

a cam comprising a solenoid notch wherein the cam rotates within the cast housing, wherein a cam axle mount positions the cam, and wherein the cam locks and frees a cam actuator;

a solenoid that, when not energized, extends to directly engage the solenoid notch to lock the cam such that the cam actuator is locked and that, when energized, retracts to allow the cam to rotate and free the cam actuator;

a spring and a ball bearing wherein the spring presses the ball bearing against the cam and wherein the cam has a cam profile that is adapted for snap over center operation; and a current rectifier wherein the solenoid can be energized by either AC or DC current to thereby provide an elevator door interlock.

10. The system of claim 9 wherein the cast housing comprises two locking fixture windows on opposite sides of the cast housing wherein the cast housing is symmetrical such that the locking fixture windows are mirror images of one another and wherein the cam actuator enters the cast housing through one of the two locking fixture windows.

11. The system of claim 10 further comprising a cast cover comprising a solenoid mount portion and a cam axle mount.

12. The system of claim 9 further comprising a cast cover comprising a manual release window.

13. The system of claim 9 further comprising a means for reconfiguration such that rearranging the components within the cast housing configures the elevator door interlock for left side or right side operation.

14. The system of claim 9 wherein the cast housing comprises a means for reconfiguring the elevator door interlock for left side or right side operation without requiring additional parts.

* * * * *